United States Patent [19]

Schwaab et al.

[11] 4,346,656

[45] Aug. 31, 1982

[54] DEVICE FOR MAKING PRINTED MATTER WITH CHANGING IMPRINTS

[75] Inventors: Manfred Schwaab, Ludwigshafen-Oggersheim; Helmut Puschnerat, Worms; Kurt Storz, Neutrauchburg, all of Fed. Rep. of Germany

[73] Assignee: Albert-Frankenthal, AG, Frankenthal, Fed. Rep. of Germany

[21] Appl. No.: 255,150

[22] Filed: Apr. 17, 1981

Related U.S. Application Data

[63] Continuation-in-part of Ser. No. 84,328, Oct. 12, 1979, abandoned.

[30] Foreign Application Priority Data

Oct. 12, 1978 [DE] Fed. Rep. of Germany ..... 2844418

[51] Int. Cl.[3] ..... B41F 7/10; B41F 13/46

[52] U.S. Cl. ..... 101/181; 101/182; 101/228

[58] Field of Search ..... 101/178, 179, 180, 181, 101/182, 183, 184, 185, 219–221, 222–224, 225, 228

[56] References Cited

U.S. PATENT DOCUMENTS 2,425,167 8/1947 Whitehead ..... 101/221

2,444,547 7/1948 Whitehead ..... 101/221

*Primary Examiner*—J. Reed Fisher

*Attorney, Agent, or Firm*—Allison C. Collard; Thomas M. Galgano

[57] ABSTRACT

In order to prevent waste and to improve the operating safety and easy operation of a device for making printed matter with changing prints or for adding further printing to a complete print, further printing units are provided associated with a printing unit having a common counterpressurer cylinder which is constantly connected with the main drive of the machine. The printing units are each provided with a normally passive acceleration motor and after completing the acceleration process are coupled (or decoupled) with the main drive of the machine by means of a coupling, having a movable coupling element which is operatively mounted independently of the print unit gear train and which is actuated by an adjustment device.

8 Claims, 5 Drawing Figures

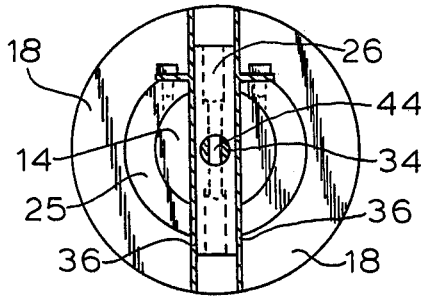
FIG.6
FIG.5
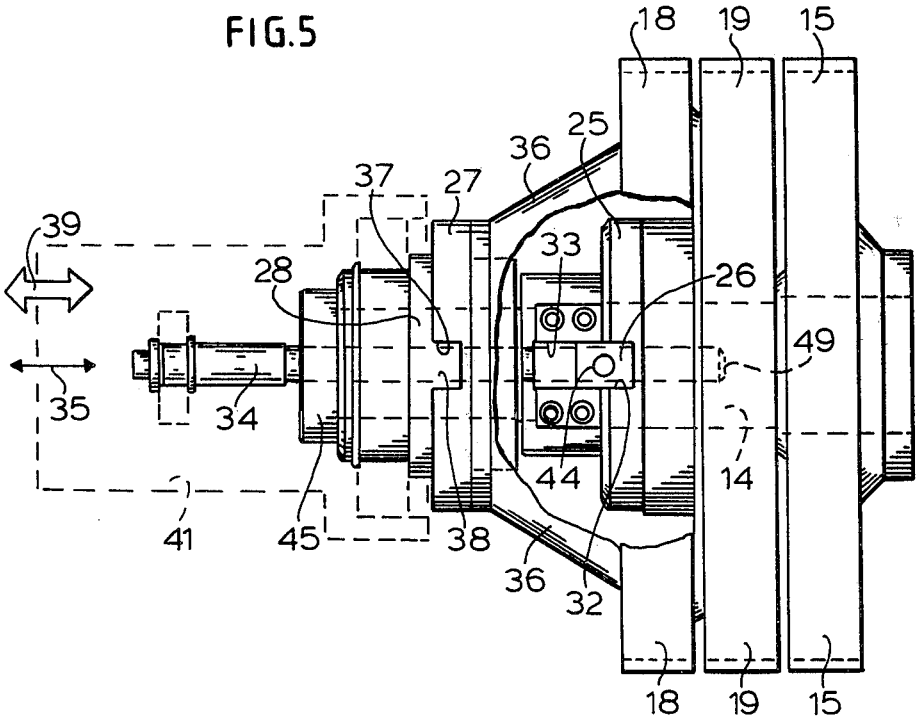

DEVICE FOR MAKING PRINTED MATTER WITH CHANGING IMPRINTS

The present invention is a continuation-in-part of application Ser. No. 84,328 filed Oct. 12, 1979, now abandoned.

The invention relates to a device for making printed matter with changing imprints or for adding additional printing to a completed print. More particularly, it relates to a device including an additional printing unit—namely, a supplementary imprint unit which comprises at least two independently operated and alternately activated and deactivated printing means and a common counterpressure cylinder around which the paper web to be printed is fed.

A device of this type is disclosed in German Laid Open Patent No. 2,033,836. However, in this known arrangement, when changing the plate, the deactivated printing means is not switched off by the counterpressure cylinder, but rather the plate cylinder is pivoted away from the adjacent cylinder or vice versa. Therefore, with this known device, the plate cylinder has to be operated while the adjacent cylinder runs practically at machine speed. This has an adverse effect on the operational safety as a result of which a high degree of accidents occur. In particular, with this known device, it is virtually impossible to avoid displacement of the inking mechanism and, in the case of an offset printing machine, the moistening mechanism in the machine frame; this renders the servicing of the machines rather difficult.

In the case of the known embodiment operating in an offset printing machine, a further disadvantage is that the blanket cylinder which acts as the counterpressure cylinder or the blanket cylinder which engages the passive printing means still has a certain amount of printing ink thereon, and, consequently, it prints for a certain time period the preceding print. This results in an undesirable amount of waste. Cleaning or changing the rubber cloth is not possible during the deactivation phase, since the blanket cylinder is obviously not influenced by the remainder of the printing means during deactivation or neutralization thereof.

Furthermore, German Laid Open Patent No. 2,033,836 suggests a reduction of the machine speed during activation of a print means of a print unit. This obviously is considered to be essential to keep as low as possible register or registration fluctuations during an immediate lifting of the print means as it is moved from the rest position into the full operating cycle. Here too, a lot of waste is to be expected. Therefore, the known device is very uneconomical.

It is therefore an object of the present invention to provide an improved device of the aforementioned type so that not only is waste reduced but also a high degree of operating safety is assured.

This object of the invention is obtained in that the alternately activated printing means of the imprint unit are coupled to a common counterpressure cylinder which, in turn, is coupled with the main drive of the machine. The printing means are each provided with compensating acceleration motors and, after completing the accelerating process, are coupled by means of coupling, which preferably is in the form of a plain coupling, to the main drive of the machine. The coupling has a movable or adjustable coupling element which is independent of the drive gear train of the printing means and which is activated by an adjustment means which, in turn, is activated by a synchronization drive. The synchronization device scans the machine speed and the speed of the printing means, the latter of which is accelerated from the rest position by means of the acceleration motor to the speed of the machine. When the speeds are substantially equal, the synchronization device triggers the adjustment means.

In view of the acceleration motor which is associated with each printing means and which lifts the associated printing means from the rest position and can accelerate the printing means to the operating cycle before the synchronization process and controlled coupling operation, the coupling operation is carried out smoothly, i.e., any jolts or impacts to the machine main drive, which could result in registration fluctuations, are practically eliminated. At this point, no waste is to be expected. Since the acceleration motor is deactivated after finishing the acceleration process, any load or power input or discharge is advantageously eliminated, so that register fluctuations and waste material are eliminated.

The deactivated printing means may be completely or partially, by means of a blanket cylinder, pivoted away from the common rubber counterpressure cylinder. This assures a high degree of operating safety and also offers the opportunity to wash or change the rubber cloth which is also very effective with respect to elimination of waste.

The coupling action provided in this application is such that no drive gears of the printing side drive train of the printing means have to be displaced, so that the same are always in opposite register type engagement which advantageously eliminates an after adjustment; this is also a positive feature with respect to eliminating waste.

Other objects and features of the present invention will become apparent from the following detailed description considered in connection with the accompanying drawings, which disclose a single embodiment of the invention. It is to be understood, however, that the drawings are designed for the purpose of illustration only and not as a definition of the limits of the invention.

In the drawings, wherein similar reference characters denote similar elements throughout the several views:

FIG. 5 is a side elevational view comparable to that of FIG. 3, with portions broken away to show internal construction; and FIG. 6 is a transverse sectional view taken along line 6—6 of FIG. 4.

Figure 1:
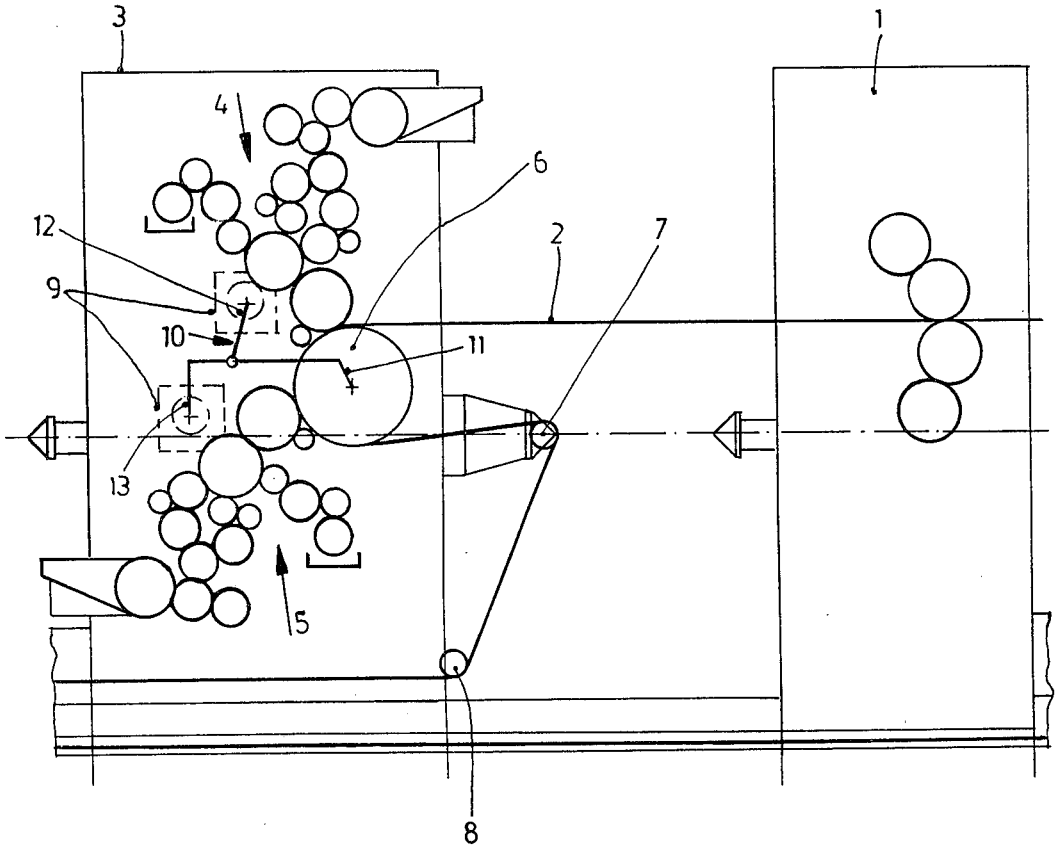
FIG. 1 is a partially schematic representation of a device in accordance with the invention together with two printing means.

Referring now in detail to the drawings, the device of the invention as shown in FIG. 1 illustrates a four color printing machine of which only one print unit 1 is shown (for simplification), as well as an imprinting or printing unit 3 which is provided in front of paper web 2. Imprinting unit 3 encompasses two complete printing means or units 4 and 5 disposed one above the other. The structure of printing units 4 and 5 is well known in the art. In the illustrated embodiment, it is an offset printing means which may also be used in the multi-colored printing machines.

A counterpressure or impression cylinder 6 is associated with printing means 4 and 5 which is in the form of a rubber roller around which the paper web is fed, over an arc or angle of 180°. For this purpose, paper web 2 is first fed below lower printing unit 5, through imprinting unit 3 and then subsequently to the print unit 1 of the multi-colored printing machine. The required deflection rollers are shown at 7 and 8. Such a paper web feeding is made possible since paper web 2 is fed in unprinted condition to imprinting unit 3 (due to the latter's disposition in front of the multi-colored printing press) where it is printed on one side. The paper web is then fed through printing units of the multi-colored printing machine without intermediary guidance or deflection means, wherein both sides of the paper web are printed.

Printing units 4 and 5 of the imprinting unit 3 are operated independently of each other as well as independently of print unit 1 and the print units which follow print unit 1. These print units 4 or 5 are activated and are brought in the operating position with respect to the counterpressure cylinder 6 by means of an adjustment or control mechanism. The control mechanism used for this purpose is generally known in the art and essentially corresponds to the adjustment units used in printing unit 1 etc. of the multi-colored printing press. In the operative position, the printing means 4 or 5 of imprinting unit 3 is included in the overall automatic operation of the total machine so that when the machine is restarted after a stoppage, the adjustment means of the operating printing means 4 or 5 of imprinting unit 3 may be mounted on a longitudinal shaft (not shown in detail) which extends across all of the printing units of the multi-color machine, and imprinting unit 3, with the individual units being connected with this shaft by means of suitable cone head or bevel drives. In the area of the imprinting unit 3, the counterpressure cylinder 6 is always driven by the aforementioned longitudinal shaft by the main drive.

Either printing means 4 or 5 of imprinting unit 3 are coupled with the machine main drive during the normal printing operation. When reaching the required number of printed pieces, the printing means 4 or 5 which is in printing position is disengaged from the main drive of the machine. Simultaneously, the other printing means 4 or 5 which has been prepared for printing is coupled to the machine main drive. Therefore, the change of printing plates is continuous. For eliminating a sudden jolt to, or shock-like stress of, the main drive of the machine when shifting from one printing means 4 or 5 of imprint unit 3 to the other, an acceleration motor 9 is provided for each of the printing means which accelerates the unit to be activated from its resting position to the operating speed of the main drive of the machine.

These acceleration motors 9 are intended to be operated manually by means of a push button. As soon as the operating speed is obtained, the accelerated printing means is coupled with the main drive of the machine by means of a switch coupling. Since further acceleration is no longer required, the coupling or clutching operation occurs rather smoothly so that a jolt or shock-like stress to the main drive, which may result in register or registration fluctuations, is eliminated.

For monitoring the required constant running of the main drive of the machine and the acceleration drive, a conventional synchronization device 10, well known to those skilled in the art, is provided; see, for example, *Siemens Review*, XLV (1978) No. 11, pages 486–492. As schematically shown in FIG. 1, the synchronization device essentially consists of a guide tachometer 11 which scans the speed of the counterpressure cylinder 6 and the speed of the main drive of the machine, as well as a pair of tachometers 12 and 13, each of which scan the speed of one of the acceleration motors 9. The current which is emitted from the guide tachometer 11 is compared with the current which is emitted from the tachometers 12 or 13 and, at almost equivalent values, triggers a signal for activating the coupling operation (not shown in detail in FIG. 1) for connecting the accelerated printing means 4 or 5 with the main drive of the machine. Instead of the aforementioned analog operating synchronization means, a digitally operating synchronization means could be used.

Figure 2:
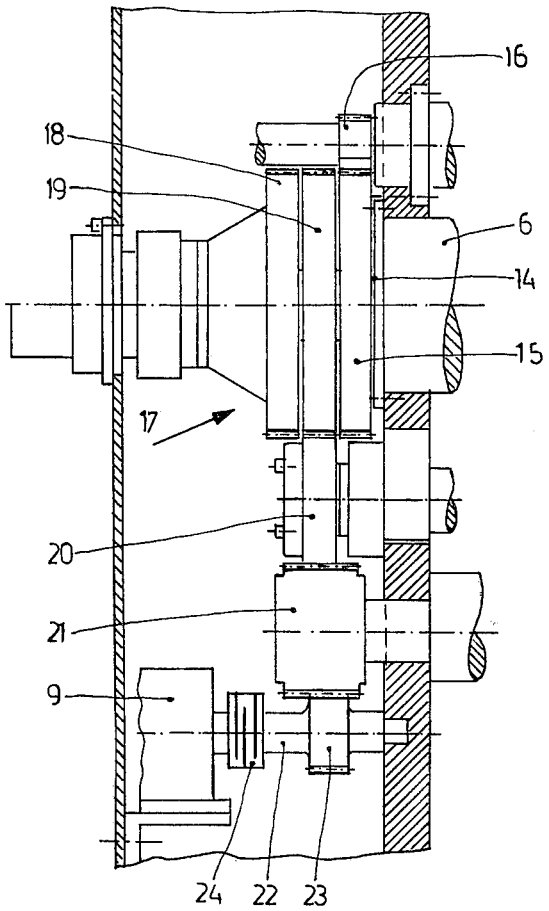
FIG. 2 is a fragmentarily-illustrated side sectional view, in part elevation, of the drive side of the unit shown in FIG. 1.

As shown in FIG. 2, counterpressure cylinder 6 is coupled with a drive wheel or gear 15 rigidly mounted on a lateral shoulder of drive shaft stub 14. A pinion 16 is in constant rotatable connection with the main drive of the machine. A drive unit 17 for printing units 4 and 5 is disposed laterally of drive wheel 15 on the shoulder of drive shaft stub 14 of counterpressure cylinder 6. Drive unit 17 is provided with drive wheels or gears 18 and 19, provided for each of the printing means 4 and 5, respectively, which are mounted for free rotation on the drive shaft stub 14 which acts as the support for counterpressure cylinder 6. Each of the gears 18 and 19 is rotatably engageable or releasable via a coupling (described hereinbelow) to the drive shaft stub 14.

In the illustrated embodiment, drive gear 19 for lower printing means 4 meshes with blanket cylinder drive wheel or gear 20 which, in turn, is in engagement with the plate cylinder drive wheel or gear 21 from which the drive of the friction cylinder can be picked off in a known manner (and which therefore is not shown in detail). As shown, the plate cylinder drive gear 21 is simultaneously in engagement with a drive pinion 23 which is disposed on the drive shaft 22 of acceleration motor 9. Naturally, it would be conceivable to feed the acceleration torque or moment of motor 9 at another suitable place to the gear train which is associated with printing means 5.

The acceleration motors 9 are coupled with drive shaft 22 via clutch 24. Thereby, it is possible to completely detach the acceleration motor 9 from the gear train after acceleration. In the shown embodiment, clutch 24 is an electromagnetic disc clutch which is actuated by means of a limit switch (not shown) of the drive gear 18 or 19 which is to be activated with the associated switch coupling (described hereinafter). This limit switch also simultaneously turns off the acceleration motor 9 (i.e., it cuts the motor off from current).

As can be seen in FIGS. 3–6, a switch coupling is provided for coupling the drive gears 18 or 19 with drive shaft stub 14 and thereby with the main drive of the machine which is preferably a so-called plain coupling and which is used for preventing a subsequent register adjustment. For this purpose, coupling elements are used which are engageable like a groove and joint connection, as can be seen with respect to the coupling elements 25 and 26 for drive gear 19 and with respect to coupling elements 27 and 28 for drive gear 18.

Figure 3:
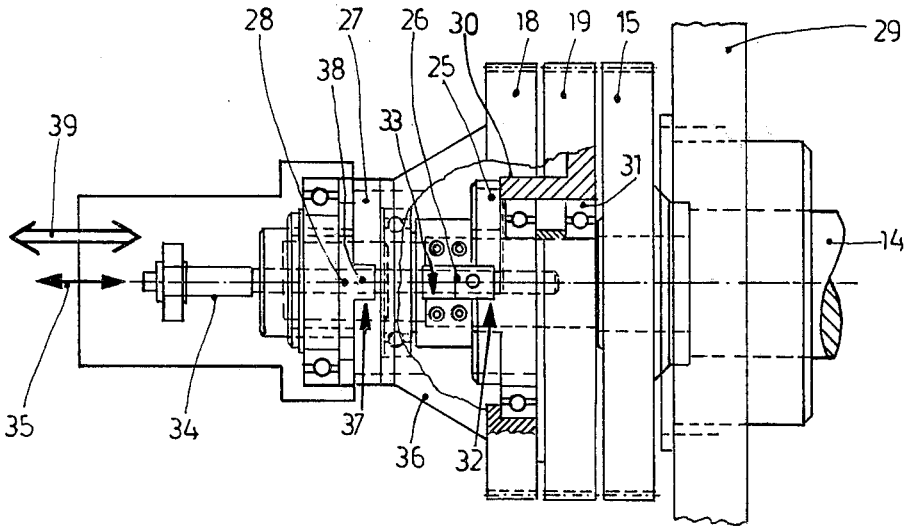
FIG. 3 is a fragmentarily-illustrated side elevational view, in part section, of the unit in accordance with FIG. 1, showing the associated drive unit as well as the associated couplings.
Figure 4:
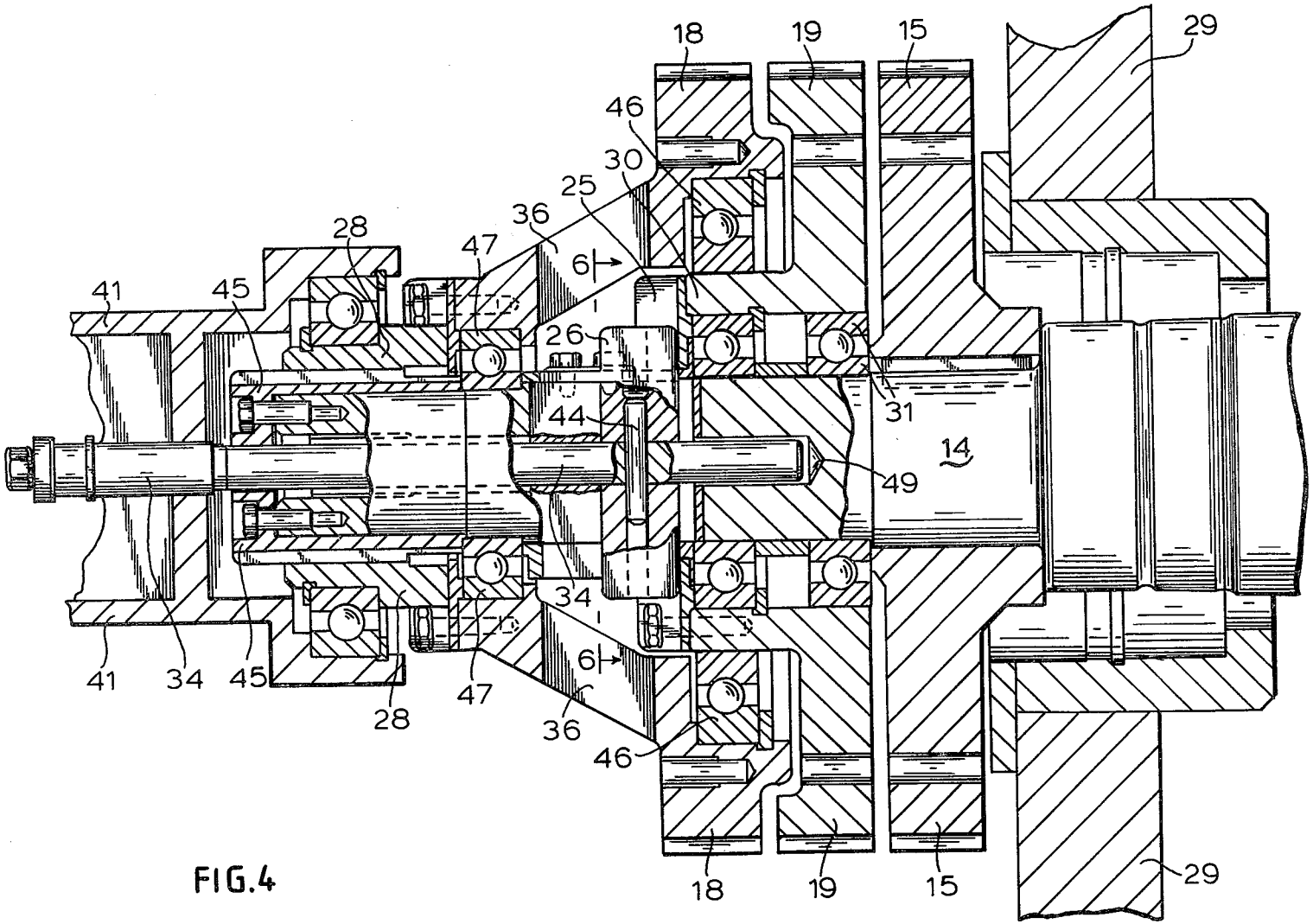
FIG. 4 is a fragmentarily-illustrated longitudinal sectional view, in part elevation, of the unit shown in FIG. 3.

As can be seen in FIGS. 3, 4 and 5, drive gear 19 which is disposed adjacent to drive gear 15 in the proximity of the machine wall 29, has a lateral annular shoulder 30 and is mounted for free rotation on drive shaft stub 14 via a ball bearing assembly 31. The end of shoulder 30 is attached to an annular coupling element 25 which is also received on the drive shaft stub 14, and which has a forwardly-opening front groove 32. A coupling element 26 is mounted on a longitudinally reciprocable adjusting rod 34 via a central pin 44, which rod 34 is disposed in a central longitudinally-extending axial bore 49 of drive shaft stub 14. Coupling element 26 is slidably coupled with drive shaft stub 14 via a slot 33 therein so as to effect rotation of said coupling element 26 therewith. Coupling element 26 serves as a cam or wedge and is configured for receipt within groove 32 upon displacement of rod 34 to the position shown in FIGS. 3, 4 and 5, so as to thereby form, in effect, a groove and joint connection. As a result, the rotational movement of drive shaft stub 14 is imparted via coupling elements 25, 26 to drive gear 19. On the other hand, upon reciprocation of rod 34 in an opposite longitudinal direction (to the left in FIGS. 3, 4 and 5), the coupling element 26 is disengaged from groove 25 and, therefore, drive gear 19 is disengaged from drive shaft stub 14.

Movement of adjusting rod 34 is effected by conventional position adjustment, control or trigger means 35 (schematically illustrated) for effecting movement of rod 34 in, e.g, an electric, hydraulic, pneumatic or mechanical manner. For example, position adjustment means 35 could comprise a double-acting hydraulic or pneumatic cylinder. Alternately, an electro-magnetic solenoid could be employed.

Drive gear 18 which is arranged adjacent to drive gear 19 is provided with a frustoconical bridging sleeve 36 which bridges the space occupied by coupling elements 25 and 26; sleeve 36 could instead be made of ribs (not shown). Sleeve 36 is attached to an annular coupling element 27 which is also received about drive shaft stub 14. Annular coupling element 27 is provided with a front groove 37 in which a cam or wedge segment 38 of a coupling element 28 engages in a similar manner to the engagement of coupling elements 25 and 26. Coupling element 28 is formed as a displacement bushing which is mounted either directly on drive shaft stub 14 or, as illustrated, on a cap 45 via a wedge-like tooth arrangement well known in the art which is fixedly connected to drive shaft stub 14. Coupling element 28 is also axially adjustable by means of a sleeve 41 coupled to a conventional position adjustment device 39, schematically illustrated. As shown best in FIG. 4, drive gear 18 is supported, on the one hand, on annular shoulder 30 of drive gear 19 and, on the other hand, in the area of the free end of bell-shaped sleeve 36 directly on drive shaft stub 14 for free rotation thereabout, via ball bearing assemblies 46 and 47, respectively. However, upon movement of displacement bushing 45 to the position shown in FIGS. 3, 4 and 5, by sleeve 41 and position adjustment means 39, wedge segment 38 of coupling element 28 engages groove 37 of coupling element 27, so as to thereby form, in effect, a groove and joint connection. As a result, the rotational movement of drive shaft stub 14 is imparted via cap 45, and coupling elements 27 and 28 to sleeve 36 and drive gear 18. On the other hand, upon reciprocation of bushing 45 in an opposite longitudinal direction (to the left in FIGS. 3, 4 and 5), the wedge segment 38 of coupling element 28 is disengaged from groove 37 of coupling element 27 and, therefore, drive gear 18 is disengaged from drive shaft stub 14.

The position adjustment means 35 or 39 for the axial displacement of the coupling elements 26 or 28 which serve as an engaging or disengaging movable coupling are activated to an operative or starting position by a conventional synchronization device 10, as previously described. Movement to an uncoupling position is effected manually when desired by pressing a button to activate the position adjustment means. For securing the coupling elements 26 or 28 in the starting, as well as in the uncoupled position, and therefore assuring a safe operation, a retaining force in the starting position, as well as in the uncoupled position, is applied by the adjustment means 35 or 39. Hence, the aforementioned adjustment means are always in an operative mode, in either one or the other direction; i.e., the adjustment means, i.e., a double-acting cylinder, constantly applies a positive force to maintain the respective movable coupling element in either end position thereof.

In order to assure that the cam wedge 26 or 38 automatically engages into the associated front face groove 32 or 37, it is required that the adjustment means 35 or 39 be previously actuated to start the coupling process while a relative movement still exists between drive gear 18 or 19 which is driven by acceleration motor 9 and drive shaft stub 14 which is driven at the speed of the main drive of the machine. This is because when actuating the associated acceleration motor 9, an acceleration is obtained up to the rate of rotation of drive shaft stub 14. During the acceleration process, i.e., as long as a relative movement is present between the associated coupling elements 25, 26 or 27, 28, wedge 26 or 28, respectively, moves repeatedly by the associated groove 32 or 37, respectively. As soon as the synchronous movement is obtained, no relative movement occurs between the associated coupling elements. Therefore, the wedge 26 or 28, can only be inserted into the associated groove 32 or 37, respectively, if the same would be located at a suitable angle position. However, such a perfect registration at the time of synchronization cannot always be expected. For this reason, it is necessary to already initiate the coupling process as long as there still is a relative movement between the individually associated coupling elements, i.e., as long as the wedge 26 or 28, respectively, still passes by the associated groove 32 or 37, respectively. The coupling process is carried out in that the movement of rod 34 or sleeve 41 to the right is initiated prior to full synchronization.

Therefore, the synchronization device 10 which activates the adjustment means 35 or 39 has to be adjusted accordingly in a known manner to produce a triggering signal at an appropriate point prior to full synchronization. The limit switch for switching off the acceleration motor 9 and for moving the coupling 24 to the starting position of the switch coupling may coact with the rods of adjustment means 35 or 39. In the shown embodiment, the limit switch (which is not shown) should be disposed in the area of the groove bottom of front face groove 32 or 37.

The aforementioned arrangement permits the making of a multi-colored prospectus which can be printed with different company names in the complete print method, whereby due to the continuous plate change in the print unit 3, no interruption occurs in the operation when changing company names. While, for example, the upper printing means 4 of printing unit 3 is in operation, the lower printing means 5 may be out of operation for changing plates. As soon as the predetermined amount of printed pieces has been achieved in the upper printing means 4, the prepared printing means 5 is brought into operating position by switching on the associated acceleration motor 9. Thereby, an acceleration takes place for the printing means 5 from its rest position to its operating speed. As soon as this is achieved, the synchronization device 10 emits a pulse to the associated position adjustment means 35 which moves coupling element 26 into engagement with groove 32 of coupling element 25, and thereby couples the total printing means 5 and drive gear 19 with the main drive.

Since the gear train of the print means 5 which leads to drive gear 19 is never uncoupled and in view of the fact that coupling element 26 also engages at a defined position, a full registrability is provided. In the shown embodiment, the counterpressure cylinder 6 has a diameter double that of the coacting offset cylinders of printing means 4 or 5 so that two offset positions of the coupling elements 25 and 26 or 27 and 28 are offset by about 180°, so that a complete registrability is assured. As soon as the coupling procedure is accomplished, the printing means 4 which is no longer required can be brought into rest position by means of pressing a button, and can be prepared for the next printing operation by changing the plates.

In the deactivated state, the gear train on the print side is completely uncoupled from the main drive of the machine and the blanket cylinder of the printing unit is moved away from the continuously running counterpressure cylinder. Essentially, the blanket cylinder is so mounted that it is movable away from the counterpressure cylinder as well as from the associated plate cylinder. A displacement of further structural elements or parts is not required. After moving the blanket cylinder to an inoperative position, the rubber cloth may be washed or changed. At the same time a high degree of safety is assured when changing the plates.

In a production process wherein the changing of prints is not necessary, two colors may be printed with the print unit 3, so that it is possible, for example, to provide a final print by employing the print unit 3 and the two successive print units 1, so as to obtain a contrast print with four color final print and two color contrast print which enhances the economics of the device considerably.

It should be pointed out that the circuitry for the synchronization and position adjustment means, including the limit switches, manual and automatic controls, etc., are conventional in the art (see, for example, the previously cited Siemens publication, as well as U.S. Pat. No. 2,425,167. This also applies to the construction and adjustability of the blanket cylinder (see, e.g., U.S. Pat. No. 1,086,722). Thus, only the essential and novel features of the invention have heretobefore been described in detail.

While only a single embodiment of the present invention has been shown and described, it will be obvious that many changes and modifications may be made thereunto, without departing from the spirit and scope of the invention.

What is claimed is:

1. In a machine for making printed matter with changing imprints or for adding additional printing to a completed print with further printing units which comprises two independently operated and actuated printing means and a common counterpressure cylinder with which said printing means coact and at least partially around which a paper web to be printed is fed, the improvement comprising:

said printing means being disengageably coupled with said counterpressure cylinder which;

a pair of normally deactivated acceleration motors, each of which is coupled to one of said printing means and which may be activated to bring the associated printing means to the operating speed of the main drive of the machine;

coupling means associated with each of said printing means for coupling each of said printing means to the main drive of the machine following the acceleration process performed by said acceleration motor, said coupling means each having a movable first coupling element and fixed second coupling element for effecting coupling and uncoupling of the associated printing means;

adjustment means associated with each of said coupling means for actuating said first coupling elements between said coupling and uncoupling positions thereof; and a drive assembly for each of said printing means which includes a main drive shaft on which said counter pressure cylinder is mounted, a main drive gear affixed on said main drive shaft for effecting rotation thereof, a pair of drive pinions for driving said printing means, each of which is supported for free rotation on said main drive shaft in a fixed axial position thereon, each of said drive pinions having said second coupling element of the associated coupling means rigidly affixed thereto which is disposed for engagement with the associated movable first coupling element, and said movable first coupling element being supported in an axially adjustable and non-rotatable manner on said main drive shaft and being coupled to said associated adjustment means.

2. The machine in accordance with claim 1, wherein each of said second coupling elements has a groove and wherein said movable first coupling elements each has a cam which is engageable with said groove of said associated second coupling element.

3. The machine in accordance with claim 1, wherein said movable first coupling elements are coupled to said associated adjustment means and are held in said coupling and uncoupling positions thereof by said associated adjustment means.

4. The machine according with claim 1, wherein each of said acceleration motors is coupled to said printing means associated therewith by means of a clutch.

5. The machine according to claim 1, wherein said drive shaft of said drive assembly constitutes the drive end of said counterpressure cylinder.

6. The machine according to claim 1, additionally including a machine side wall through which said main drive shaft extends, and wherein said main drive shaft has an axial bore and a support slot, wherein one of said drive pinions has an annular lateral shoulder on which the other of said drive pinions is mounted, wherein said second coupling element affixed to said one drive pinion comprises a groove formed in the front face of said lateral shoulder thereof and said movable first coupling element associated therewith comprises a cam wedge which is displaceably mounted in said support slot of said main drive shaft and wherein said adjustment means includes an adjustment rod which is displaceably mounted in said axial bore and coupled to said movable first coupling element of said one drive pinion for effecting movement thereof in said support slot and wherein said other drive pinion has a lateral sleeve which is provided with an annular element having a groove which serves as said second coupling element affixed thereto, and wherein the movable first coupling element associated with said other drive pinion comprises a displaceable sleeve having a cam wedge for receipt in said groove of said annular element.

7. The machine according to claim 1, additionally including a synchronization device for triggering said adjustment means, said synchronization device having means for monitoring the speed of the main drive of the machine and the speed of said printing means.

8. The machine according with claim 7, wherein said means for monitoring of said synchronization device includes two DC current tachometers, one of which monitors machine speed and the other of which monitors the speed of the printing means to be activated.

* * * * *